US007167075B1

(12) United States Patent
Siggins et al.

(10) Patent No.: US 7,167,075 B1
(45) Date of Patent: Jan. 23, 2007

(54) DUAL DESIGN RESISTOR FOR HIGH VOLTAGE CONDITIONING AND TRANSMISSION LINES

(75) Inventors: Timothy Lynn Siggins, Newport News, VA (US); Charles W. Murray, Hayes, VA (US); Richard L. Walker, Norfolk, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 214 days.

(21) Appl. No.: 11/003,478

(22) Filed: Dec. 3, 2004

(51) Int. Cl.
*H01C 10/38* (2006.01)

(52) U.S. Cl. ..... 338/176; 338/118; 338/194; 338/202

(58) Field of Classification Search ..... 338/92, 338/95, 118, 137, 160, 176, 180–183, 185, 338/188, 189, 194, 202, 307–309, 323, 328, 338/332, 48
See application file for complete search history.

(56) References Cited

U.S. PATENT DOCUMENTS

| | | | | | |
|---|---|---|---|---|---|
| 285,778 | A | * | 10/1883 | Adams | 338/92 |
| 1,618,058 | A | * | 2/1927 | Church | 338/202 |
| 2,481,682 | A | * | 9/1949 | Payne | 338/87 |
| 3,456,228 | A | * | 7/1969 | Wright | 338/176 |
| 3,579,169 | A | * | 5/1971 | Dickinson | 338/170 |
| 3,693,062 | A | * | 9/1972 | Von Vick | 338/92 |
| 4,001,759 | A | * | 1/1977 | Bailey | 338/68 |
| 4,075,597 | A | * | 2/1978 | Peart | 338/128 |

* cited by examiner

*Primary Examiner*—Tu Hoang

(57) ABSTRACT

A dual resistor for eliminating the requirement for two different value resistors. The dual resistor includes a conditioning resistor at a high resistance value and a run resistor at a low resistance value. The run resistor can travel inside the conditioning resistor. The run resistor is capable of being advanced by a drive assembly until an electrical path is completed through the run resistor thereby shorting out the conditioning resistor and allowing the lower resistance run resistor to take over as the current carrier.

16 Claims, 9 Drawing Sheets

DUAL DESIGN RESISTOR FOR HIGH VOLTAGE CONDITIONING AND TRANSMISSION LINES

The United States of America may have certain rights to this invention under Management and Operating contract No. DE-AC05-84ER40150 from the Department of Energy.

FIELD OF THE INVENTION

The present invention relates to resistors and particularly to a dual design resistor for high voltage conditioning of electrical equipment.

BACKGROUND OF THE INVENTION

Current spikes can be damaging when directing high voltage into machinery, transmission lines, or injector guns for accelerators. In the case of accelerators for example, high current spikes at high voltage can flash and damage the injector gun of the accelerator if the power supply is not properly current limited.

At the Thomas Jefferson National Accelerator Facility, the injector gun is designed to run at a 350 kV level. At startup, the injector gun must be conditioned for a period of time to ensure that the gun electrode is stable at high voltages and without current emissions. The voltage and current are monitored on startup and when the current fluctuations measure less than a few micro amps per 15 minutes, the gun electrode is considered stable at this voltage level. The voltage is then increased 1–2 kV and the process repeated until the voltage on the gun electrode is about 10–15% above the operating voltage. The time frame involved for the gun electrode to stabilize may be as long as two days. During the stabilization period, the current available to the gun electrode is limited by the large resistance of the conditioning resistor. After the gun electrode has been properly conditioned to a voltage 15% higher than the running voltage of 350 kV, the conditioning resistor is replaced by the running resistor, which has a much lower resistance.

At present, two separate resistors are used to control the current available from the high voltage power supply to the injector gun. A high value resistor is used to reduce the current available from the power supply to a low value to condition the injector gun. A low value resistor is then substituted for the high value resistor. The low value resistor is then placed on line allowing the high voltage power supply to provide higher currents when required by the injector gun for operations.

Unfortunately, the use of two separate resistors and the task of switching them causes a great deal of down time. High voltage power supplies for FELs may reach as high as 500 kV or higher. The separate resistors are bulky and must be secured in place between the power supply and the injector gun, within a surrounding jacket, which requires several hours of unproductive time.

What is needed therefore, is a dual resistor for high voltage applications that is capable of being switched from one resistance value to another without significant downtime or disassembly. The dual resistor must be capable of limiting the current available to the gun during high voltage conditioning and of delivering large current when required by the gun during operations. The dual resistor would be useful in starting up high power accelerators, high voltage transmission lines, or other high voltage equipment in which the current must be limited for conditioning or starting purposes.

SUMMARY OF THE INVENTION

The present invention is dual resistor for eliminating the requirement for two different value resistors. The dual resistor includes a conditioning resistor at a high resistance value and run resistor at a low resistance value. The run resistor can travel inside the conditioning resistor. The run resistor is capable of being advanced by a drive assembly until an electrical path is completed through the run resistor thereby shorting out the conditioning resistor and allowing the lower resistance run resistor to take over as the current carrier.

Figure 1:
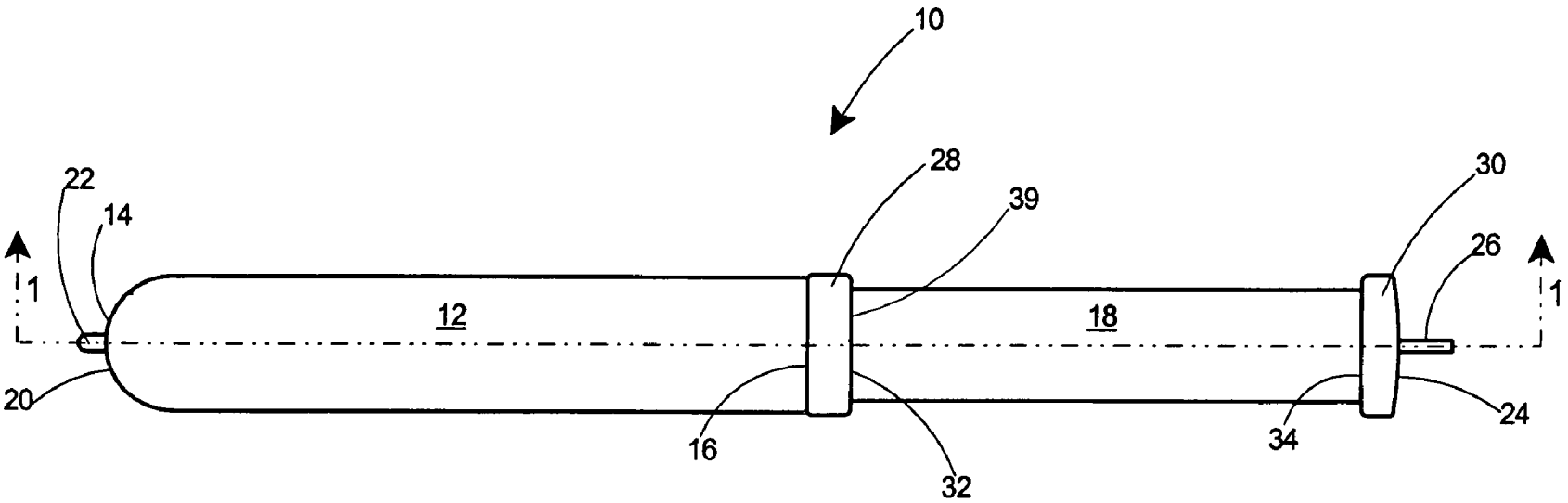
FIG. 1 is a top view of a dual design resistor according to the present invention.

Reference Numerals Used in the Specification and Drawings

10—dual design resistor
12—housing
14—first end of housing
16—second end of housing
18—conditioning resistor
20—input end of dual design resistor
22—input electrical contact
24—output end of dual design resistor
26—output electrical contact
28—upstream corona ring
30—downstream corona ring
32—first end of conditioning resistor
34—second end of conditioning resistor
36—run resistor
38—first end of run resistor
39—bayonet mount
40—second end of run resistor

41—first mounting ring
42—tubular cavity
43—second mounting ring
44—drive assembly
45—screws for bayonet mount
46—motor
47—corona ring mounting screws
48—ball screw
50—shaft
52—drive gear
54—driven gear
56—first end of ball screw
58—carriage
60—top end of carriage
62—bottom end of carriage
64—ball nut
66—limit switch striker
68—front bracket
70—rear bracket
72—front limit switch
74—rear limit switch
76—tie rod
78—nosepiece of run resistor
80—elongated ceramic cylinder
82—nosepiece of conditioning resistor
83—downstream mounting ring
84—silver layer
86—resistive layer
88—protective layer
89—silver-filled epoxy
90—faceplate
92—aperture
94—contact head
96—spring
98—electrical receptacle
100—electrical wiring

DETAILED DESCRIPTION

With reference to FIG. 1, a top view is shown of a preferred embodiment of a dual design resistor 10 according to the present invention. The dual design resistor 10 includes an electrically conductive tubular housing 12 having a first 14 and second end 16 and a tubular conditioning resistor 18 in electrical contact with and extending from the second end 16 of the housing 12. The dual resistor 10 includes an input end 20 with an input electrical contact 22 and an output end 24 with an output electrical contact 26. An upstream corona ring 28 with a bayonet mount 39 secures the housing 12 to the conditioning resistor 18 and a downstream corona ring 30 secures the conditioning resistor 18 to the output electrical contact 26. The conditioning resistor 18 includes a first 32 and a second 34 end.

Figure 2:
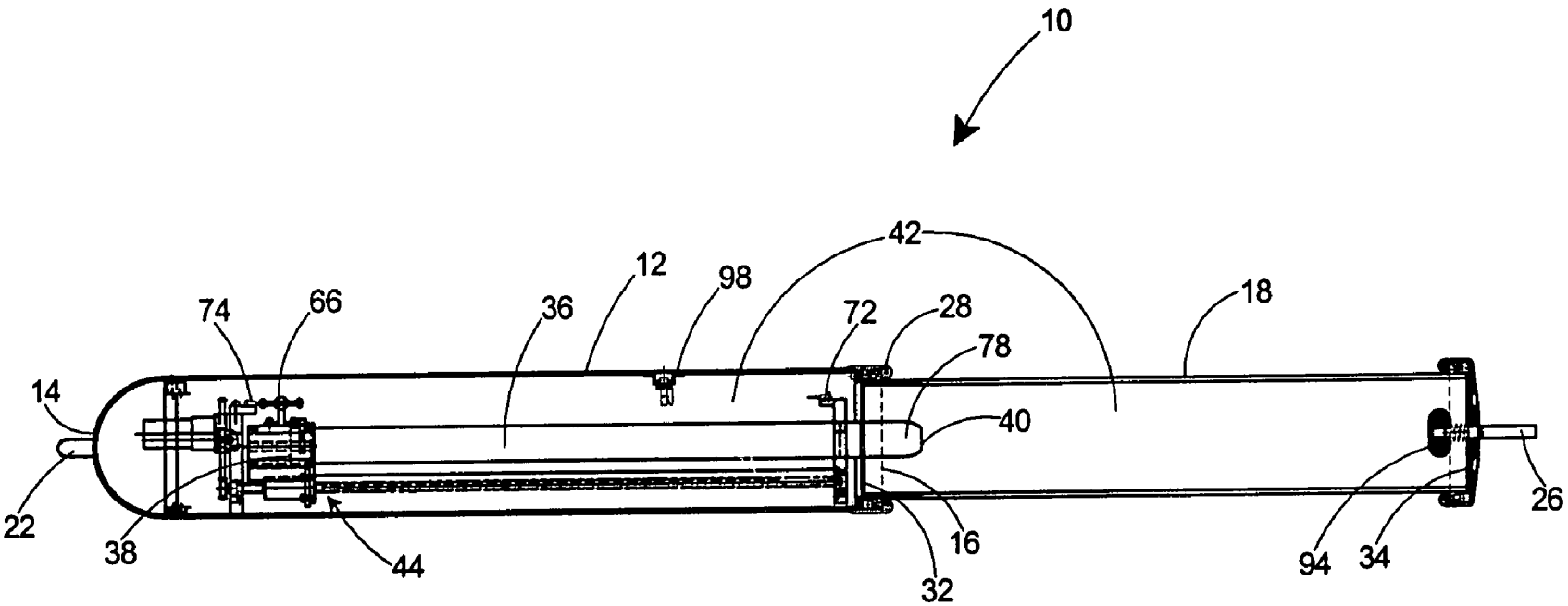
FIG. 2 is a side view of the dual design resistor of taken along line 1—1 of FIG. 1 with the housing and the conditioning resistor cut away along line 1—1 to show internal details of the dual design resistor and the run resistor retracted into the housing.

Referring to FIG. 2, a side view of the dual design resistor 10 with the housing 12 and the conditioning resistor 18 cut away along line 1—1 of FIG. 1, a run resistor 36 having a first-38 and second 40 end is disposed within the electrically conductive tubular housing 12. The first end 38 of the run resistor 36 is in electrical contact with the first end 14 of the housing 12.

Figure 2A:
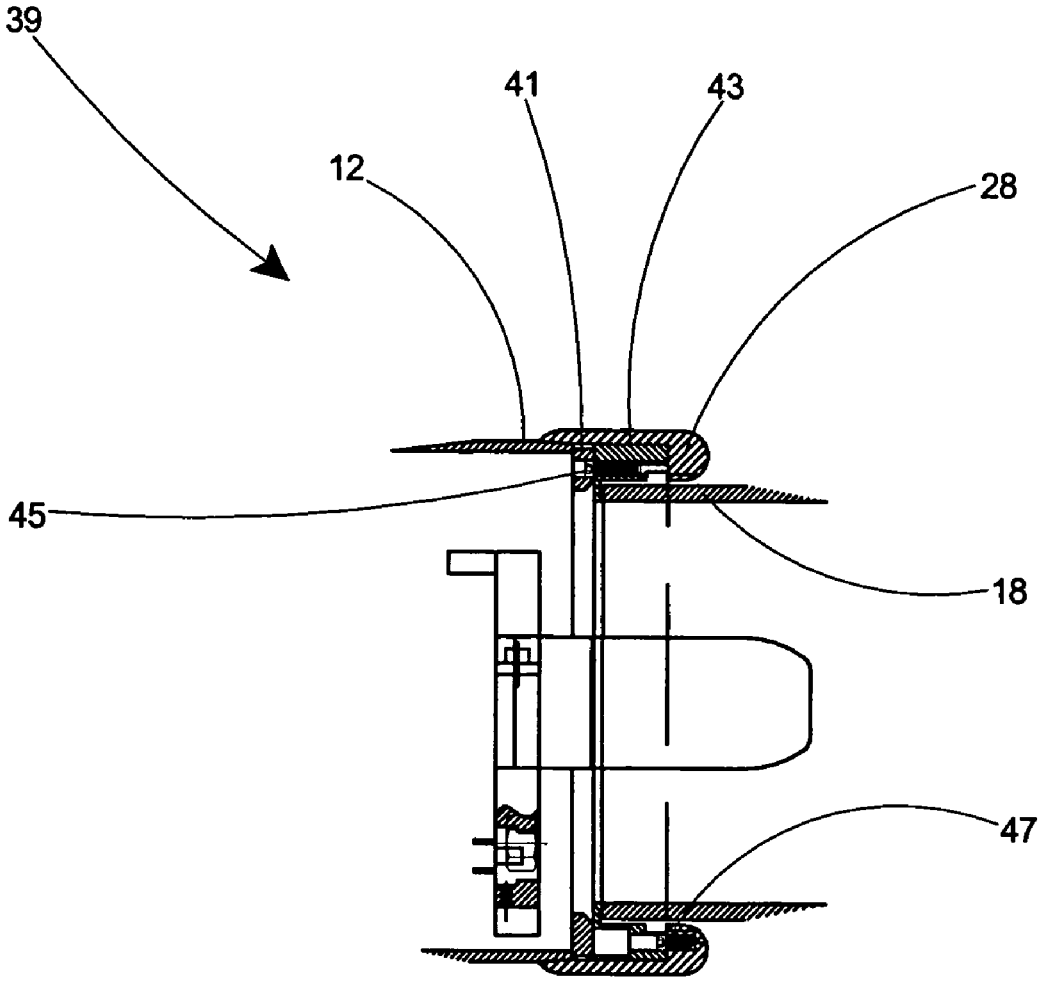
FIG. 2A is a detailed view of the middle portion of FIG. 2 showing the connection of the housing to the conditioning resistor.

As shown in FIG. 2A, the housing 12 and the conditioning resistor 18 are secured together by a bayonet mount 39 including a first mounting ring 41 and a second mounting ring 43. The first mounting ring 41 is secured to the housing 12 and includes keyhole slots (not shown) for accepting screws 45 secured to the second mounting ring 43. The upstream corona ring 28, having a smooth outer surface with no burrs or sharp edges to cause electrical arcing or flashing, covers the bayonet mount 39. Corona ring mounting screws 47 secure the upstream corona ring 41 to the second mounting ring 43. The housing 12 and the mounting rings 41, 43 are preferably constructed of an electrically conductive metal such as aluminum. The first mounting ring 41 is typically secured to the housing 12 by welding. The second mounting ring 43 is typically secured to the ceramic conditioning resistor 18 by a conductive adhesive, such as silver-filled epoxy type 761A11 or 761A12, available from McMaster-Carr Supply Company of Los Angeles, Calif.

The housing 12 and the conditioning resistor 18 define a tubular cavity 42 extending the length of the dual design resistor 10 therein. An insulating gas is disposed to completely surround all components both inside and outside of the dual resistor 10 to suppress high voltage arcing. The insulating gas is preferably sulfur hexafluoride. The housing 12 further includes a drive assembly 44 for advancing the run resistor 36 linearly within the tubular cavity 42. The conditioning resistor 18 is of a higher resistance value than the run resistor 36. The drive assembly 44 is capable of advancing the run resistor 36 until the second end 40 of the run resistor 36 establishes electrical contact with the contact head 94 on the second end 34 of the conditioning resistor 18 thereby shorting out the higher resistance conditioning resistor 18 with the lower resistance run resistor 36 and allowing the run resistor 36 to take over as the current carrier. The run resistor 36 preferably has a resistance of between 450 and 500 ohms. A particularly preferred run resistor 36 is a Type 1044AS non-inductive tubular ceramic resistor, which can be obtained from Kanthal Globar of 3425 Hyde Park Boulevard, Niagara Falls, N.Y.

Figure 3:
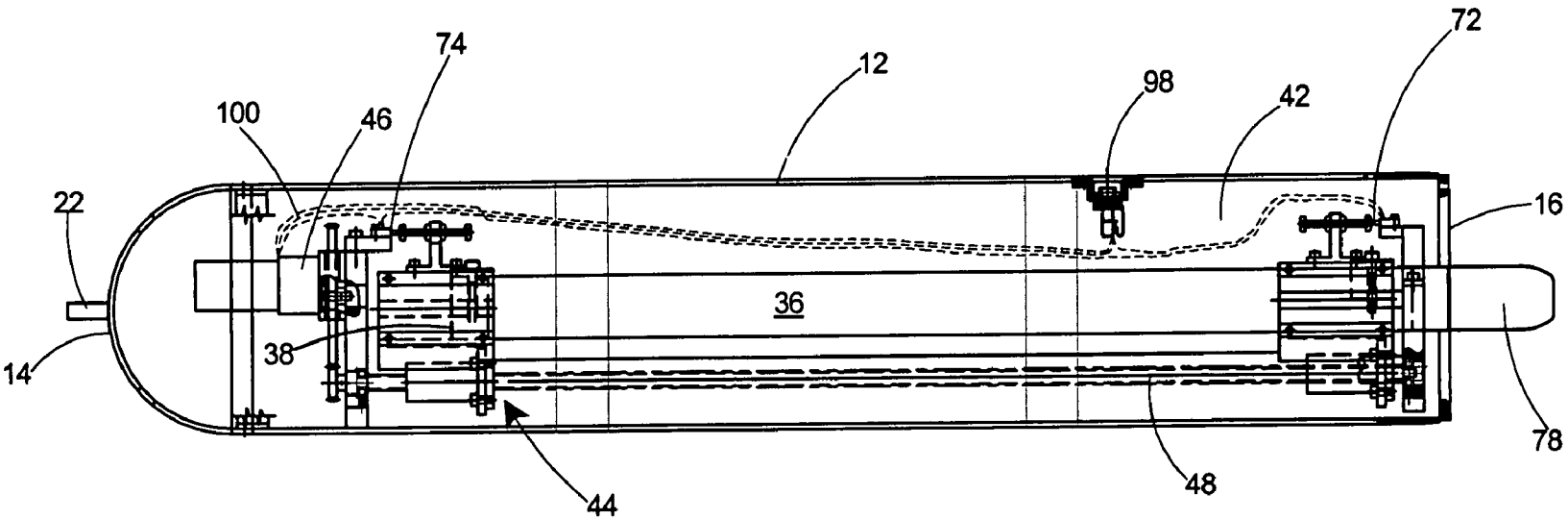
FIG. 3 is a view of the left side portion of FIG. 2 showing the details of the run resistor portion of the dual resistor.

Referring to FIG. 3, the drive assembly 44 of the dual design resistor is secured within the portion of the tubular cavity 42 that is within the housing 12. The drive assembly 44 includes a motor 46 and a ball screw 48.

Figure 4:
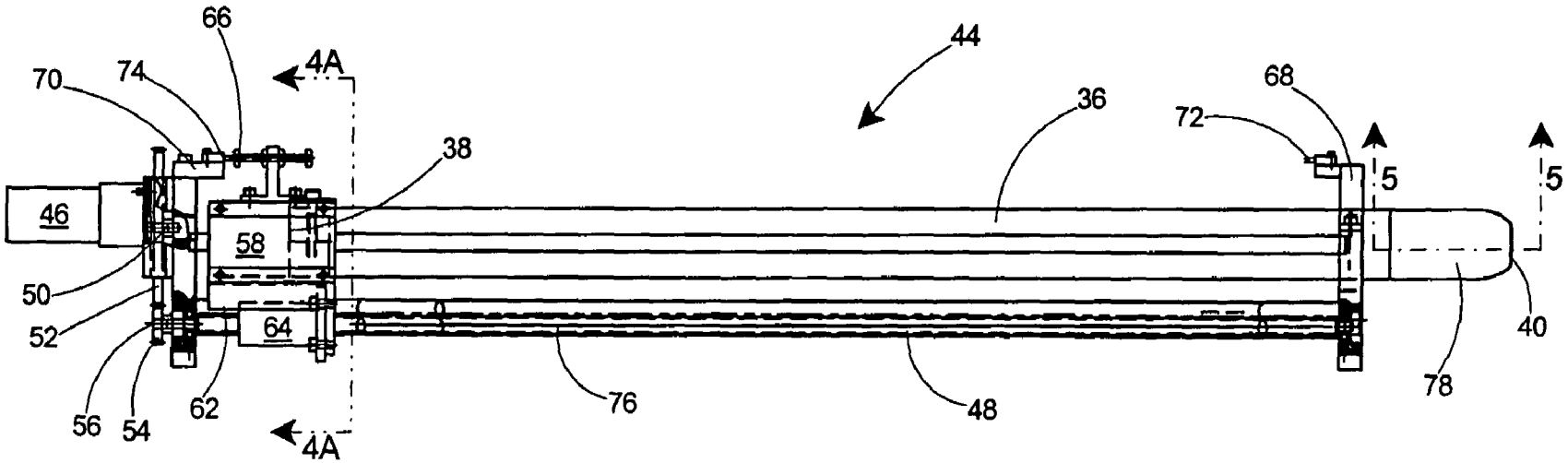
FIG. 4 is a side view of the run resistor and drive assembly portion of FIG. 3.
Figure 4A:
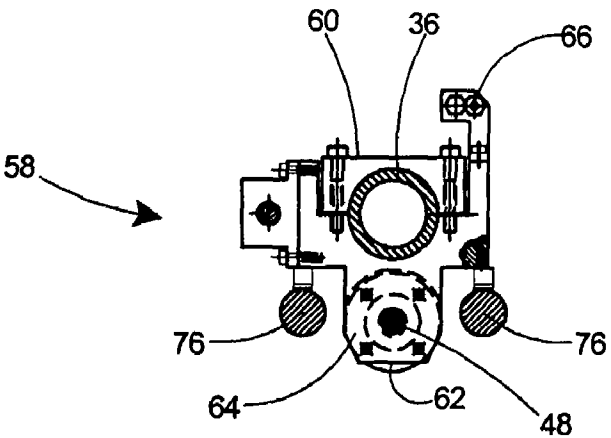
FIG. 4A is an end view of the carriage taken along line 4A—4A of FIG. 4.

Details of the drive assembly 44 are shown in FIG. 4. The motor 46 of the drive assembly 44 includes a shaft 50 and a drive gear 52 secured to the shaft 50. A driven gear 54 is included on a first end 56 of the ball screw 48. The drive assembly 44 includes a carriage 58 that has a top 60 and a bottom 62 end. A ball nut 64 is secured to the bottom end 62 and a limit switch striker 66 secured the top end 60 of the carriage 58. A front 68 and rear 70 bracket include respectively a front 72 and rear 74 limit switch. As shown the end view of the carriage 58 in FIG. 4A, two tie rods 76 are included outboard of the ball screw 48. The second end 40 of the run resistor 36 includes a nosepiece 78 secured thereto.

Figure 6:
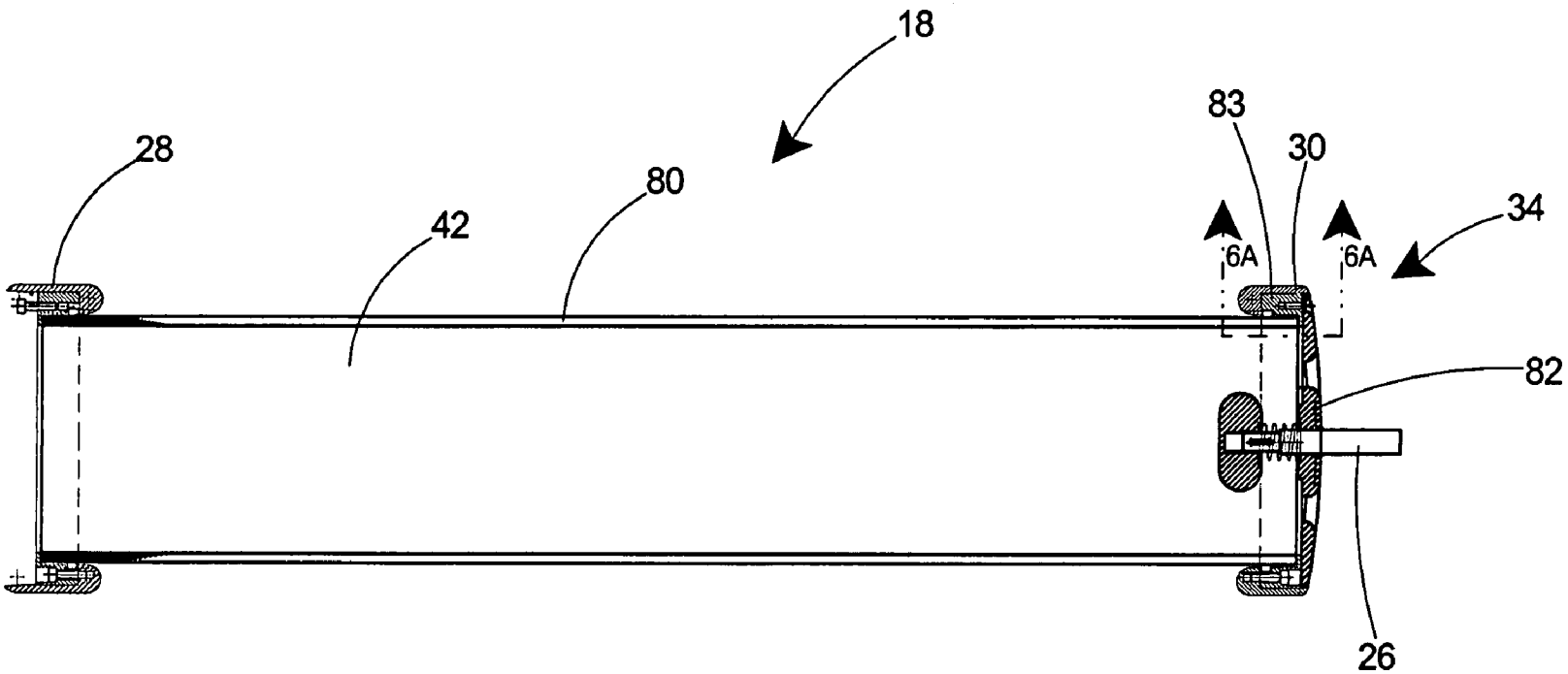
FIG. 6 is a view of the right side portion of FIG. 2 showing the details of the conditioning resistor portion of the dual resistor.

With reference to FIG. 6, the conditioning resistor 18 is constructed of an elongated ceramic cylinder 80. A nosepiece 82 is attached with screws to a downstream mounting ring 83 on the second end 34 of the conditioning resistor 18.

Figure 6A:
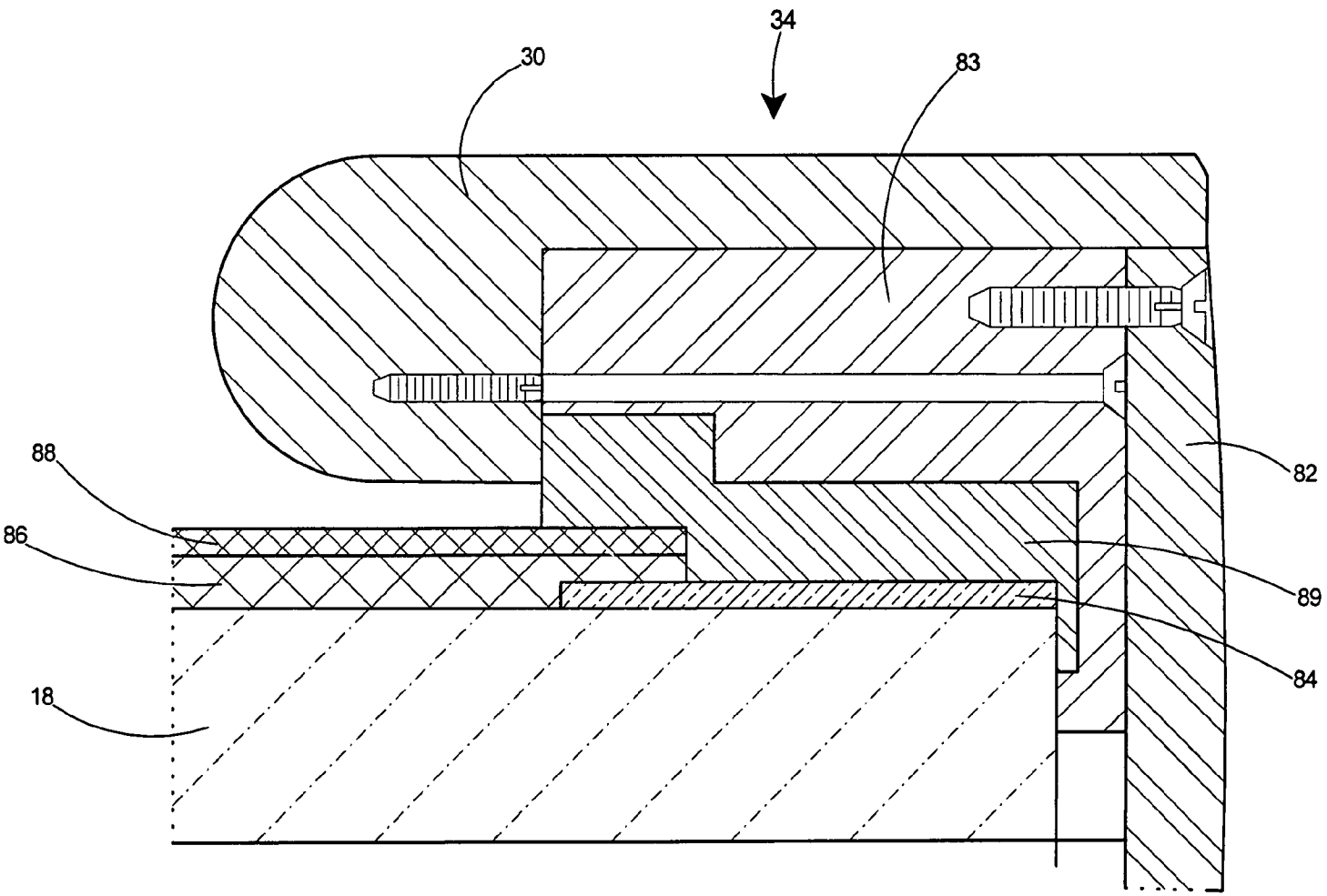
FIG. 6A is a detailed view of a portion of the top right corner of the conditioning resistor from the area delimited by line 6A—6A of FIG. 6.

Referring to FIGS. 6 and 6A, a downstream mounting ring 83 is secured to the ceramic cylinder 80 with silver-filled epoxy 89 and the downstream corona ring 30 is secured to the downstream mounting ring 83 by screws. A silver layer 84 covers the end of the ceramic cylinder 80. A resistive layer 86 overlapping a portion of the silver layer 84 and a protective layer 88 is applied over the resistive layer 86. The area between the downstream mounting ring 83 and the silver layer 84 is filled with silver-filled epoxy 89. The silver-filled epoxy 89 provides good electrical contact between the downstream mounting ring 83 and the silver layer 84 of the conditioning resistor 18. The resistance value of the conditioning resistor 18 is set by the thickness of the resistive layer 86 and the time and temperature to which it is fired. The silver layer 84 provides a method of connecting to the resistive layer 86. The protective layer 88 protects the outer surface of the conditioning resistor 18 against abrasion. The elongated ceramic cylinder 80 that forms the conditioning resistor 18 preferably has a wall thickness of between ⅛-inch and ¼-inch thick. Preferably, the conditioning resistor 18 has a resistance of between 100 and 200 Mohms.

Figure 7:
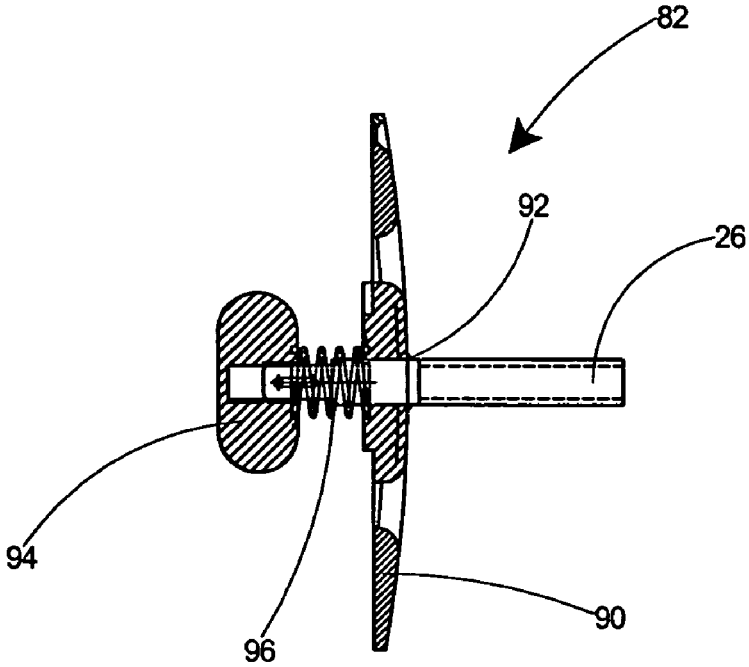
FIG. 7 is a detailed view of the nosepiece portion of the conditioning resistor of FIG. 6.

A detailed view of the nosepiece 82 portion of the conditioning resistor is shown in FIG. 7. The nosepiece 82 includes a faceplate 90 having an aperture 92 with the output electrical contact 26 fitted therein. A contact head 94 is affixed to the output electrical contact 26 by a spring pin. The spring 96 is used to maintain a good electrical contact between the nosepiece 78 of the run resistor and the contact head 94 of the conditioning resistor's nosepiece 82. The contact head 94 is constructed of electrically conductive material and will carry an electrical current to the output electrical contact 26 when it is contacted by the run resistor (not shown).

Referring to FIG. 3, the housing 12 further includes an electrical receptacle 98 and electrical wiring 100 (dashed lines) connecting the electrical receptacle 98 with the motor 46 via the front 72 and rear 74 limit switches. DC power and control for the motor 46 is provided by an external power supply and switch (not shown). The motor 46 and the ball screw 48 are disposed within the tubular cavity 42.

Figure 5:
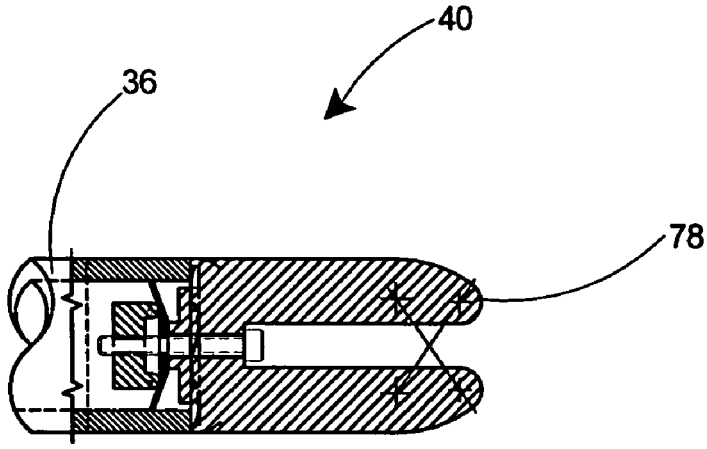
FIG. 5 is a detailed view of the nosepiece portion of the run resistor taken along line 5—5 of FIG. 4.

With reference to FIGS. 5 and 7, the run resistor nosepiece 78 is secured to the run resistor 36. The nosepiece 78 is constructed of aluminum and, upon traveling to the second end 34 of the conditioning resistor 18 (see FIG. 8), transfers electrical current from the run resistor 36 to the contact head 94 of the nosepiece 82. The end of the run resistor nosepiece 78 forms the second end 40 of the run resistor 36.

For operation of the dual design resistor 10 of the present invention, the reader is referred to FIGS. 3 and 4. The run resistor 36 is supported within the internal cavity 42 of the housing 12. In an initial state, the first end 38 of the run resistor 36 is cantilevered from the first end 14 of the housing 12. The input electrical contact 22 at the first end 14 of the housing 12 is typically at a voltage of 350,000 volts. The housing 12 is typically constructed of aluminum. The housing 12 therefore conducts electrical current from its first end 14 to its second end 16 with minimal current loss.

With reference to FIG. 2, since the insulating gas fills the tubular cavity 42 within the dual design resistor 10, and the run resistor 36 is cantilevered from the first end 14 of the housing 12, the run resistor 36 is therefore electrically insulated from the second end 34 of the conditioning resistor 18. Therefore, with a high voltage applied to the first end 14 of the housing 12, all the current flow is through the conditioning resistor 18. In a preferred embodiment, the conditioning resistor 18 has a resistance of 150 Mohms and the run resistor 36 has a resistance of 500 ohms. Applying Ohm's Law, with 350 kilovolts applied to the input electrical contact 22, and all current flow through the conditioning resistor 18, the maximum current output available at the output electrical contact 26 equals 0.0023 amps. Thus, with the run resistor 36 retracted until the limit switch striker 66 contacts the rear limit switch 74, as shown in FIG. 2, all current flow is through the conditioning resistor 18 and the maximum output current available at the output electrical contact 26 equals 0.0023 amps.

To switch the current flow of the dual design resistor 10 to the run resistor 36, the 350 kV is turned off and DC power is sent through wiring 100 and front limit switch 72 to operate motor 46, which drives carriage 58 and ball nut 64 along ball screw 48. Carriage 58 is thereby carried along ball screw 48 and carries with it run resistor 36. The run resistor 36 is therefore driven from the left to right in the FIG. 2, advancing the second end 40 of the run resistor 36 toward the contact head 94 at the second end 34 of the conditioning resistor 18.

Figure 8:
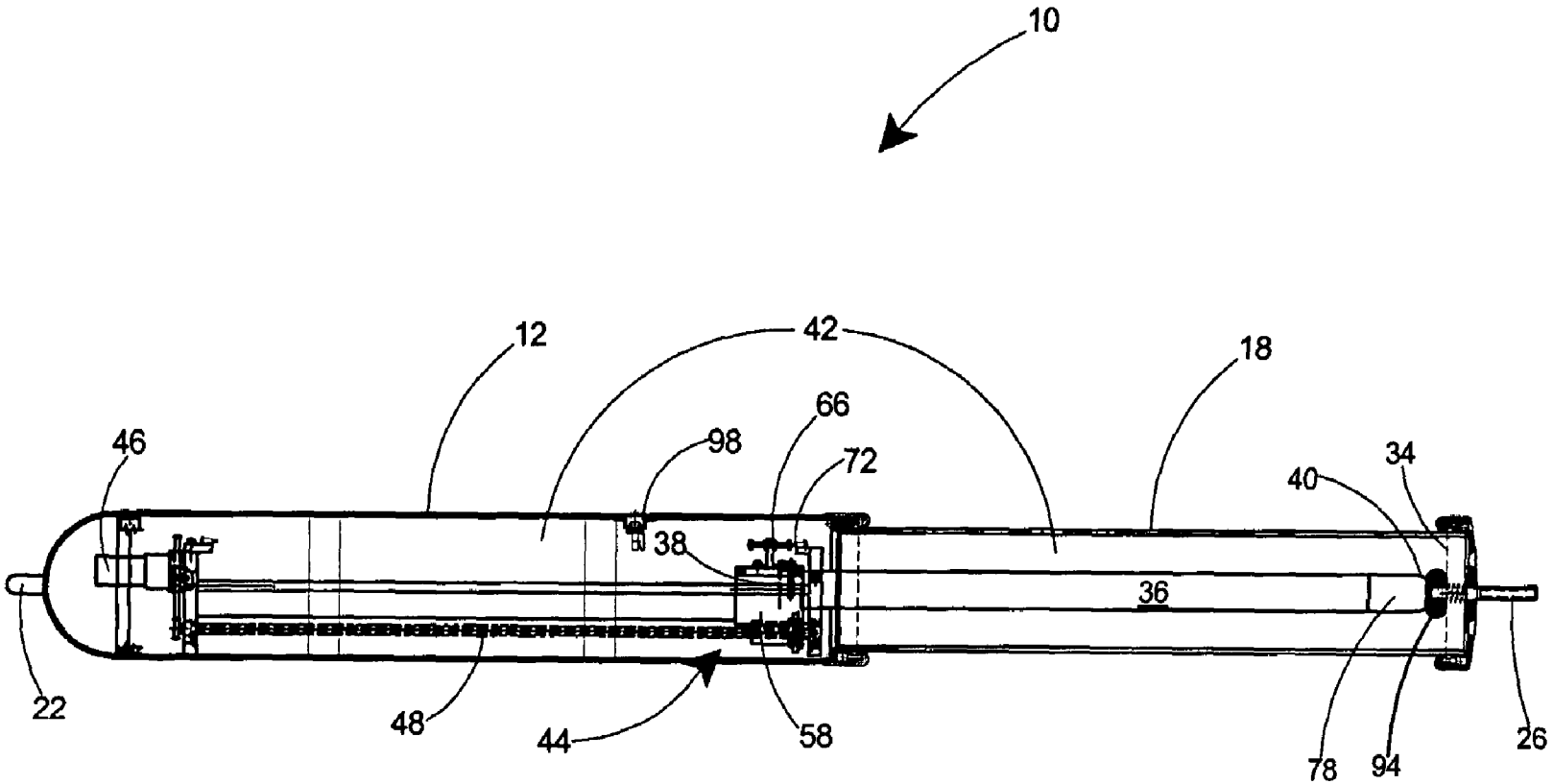
FIG. 8 is a side view of the dual design resistor taken along line 1—1 of FIG. 1 with the housing and the conditioning resistor cut away along line 1—1 to show internal details of the dual design resistor and the run resistor advanced into contact with the conditioning resistor.

Referring to FIG. 8, the second end 40 of the run resistor 36 eventually contacts and depresses the contact head 94 and the limit switch striker 66 contacts the front limit switch 72 stopping the motor 46 and the linear advancement of the run resistor 36 into the conditioning resistor 18. When the second end 40 of the run resistor 36 contacts the contact head 94, the run resistor 36, being of a lower resistance value than the conditioning resistor 18, shorts out the conditioning resistor 18 and nearly all current will now flow through the run resistor 36 when high voltage is reapplied. In the preferred embodiment, with the run resistor 36 having a resistance of 500 ohms and 350 kilovolts applied to the input electrical contact 22, the maximum current available through the run resistor 36 is 700 amps.

The dual design resistor 10 of the present invention therefore includes a first position, as shown in FIG. 2, when the second end 40 of the run resistor 36 is insulated from the second end 34 of the conditioning resistor 18 and a second position, as shown in FIG. 8, when the run resistor 36 establishes electrical contact with the contact head 94 at the second end 34 of the conditioning resistor 18. The maximum current available from the dual design resistor 10 is therefore determined by the position of the run resistor 36. The maximum current available from the dual resistor 10 is 0.0023 amps with the run resistor 36 retracted, or in the first position shown in FIG. 2, and the maximum current available is 700 amps with the run resistor 36 extended, or in the second position shown in FIG. 8.

The dual design resistor 10 of the present invention is especially useful for introducing a high voltage to downstream electrical components that are susceptible to damage by current spikes or fluctuations. Typically, when very high voltage is first applied to electrical equipment the voltage must be brought up gradually and the maximum current limited in order to prevent any major damage to the equipment. A corona discharge can emanate from any sharp or rough surfaces and they must be "high voltage processed" smooth by controlling the power (current and voltage) of the discharge. On startup of high voltage equipment, it may take one or two days to establish a steady electric field on the equipment without corona or other discharges. Power supplies to photocathode injector guns, such as those used to create electrons for accelerators that produce photons for FELs, may supply between 300 and 500 kV DC. With such high voltages involved, it is very critical to not introduce a high current immediately on startup to the injector gun, as slight fluctuations in the current can cause electrical arcing, flashing, or other damaging results. It is therefore desirable to first introduce the downstream components to a relatively low voltage with the maximum current available limited to a small value and gradually raise the voltage when there is no or very minimal current activity. Both the power supply voltage and current are monitored during high voltage processing and startup of the equipment. When the downstream equipment is able to hold a voltage that is higher than the desired operating voltage with only very low current drain, then the equipment is finished with the high voltage processing. The power supply is turned off and the dual design resistor 10 is switched from the conditioning setup, with all current through the conditioning resistor 18, to the run setup with all power through the run resistor 36.

To ensure that there is no arcing or flashing within the dual design resistor, the tubular cavity 42 and in fact the entire dual design resistor 10 is engulfed with an insulating gas, such as sulfur hexafluoride. In an especially preferred embodiment in which the run resistor 36 has a length of 24-inches and a diameter of 1.5-inches, the conditioning resistor has a length of 25.5-inches and a diameter of 5.0-inches with a wall thickness of 0.188-inch.

As the invention has been described, it will be apparent to those skilled in the art that the same may be varied in many ways without departing from the spirit and scope of the invention. Any and all such modifications are intended to be included within the scope of the appended claims.

What is claimed is:

1. A dual design resistor comprising:

a run resistor having a first end and a second end;

said run resistor disposed within an electrically conductive tubular housing having a first end and a second end;

said first end of said run resistor in electrical contact with said first end of said housing;

a conditioning resistor having a first end and a second end and an outer surface, said conditioning resistor in electrical contact with and extending from said second end of said housing;

said housing and said conditioning resistor defining a tubular cavity therein;

an insulating gas sealed in said tubular cavity; and a drive assembly within said cavity for advancing said run resistor linearly within said tubular cavity until said second end of said run resistor establishes electrical contact with said second end of said conditioning resistor thereby shorting out said conditioning resistor with said run resistor and allowing said run resistor to take over as the current carrier.

2. The dual design resistor of claim 1 wherein said drive assembly includes a motor and ball screw.

3. The dual design resistor of claim 1 wherein said conditioning resistor is an elongated ceramic cylinder.

4. The dual design resistor of claim 3 wherein said conditioning resistor includes a cylindrical outer surface and ends;

a silver layer on said ends of said cylindrical outer surface;

a resistive layer on said cylindrical outer surface and partially overlapping said silver layer; and a protective layer on said resistive layer.

5. The dual design resistor of claim 3 wherein said elongated ceramic cylinder has a wall thickness of between ⅛-inch and ¼-inch thick.

6. The dual design resistor of claim 1 wherein said run resistor is an elongated ceramic cylinder.

7. The dual design resistor of claim 1 wherein said conditioning resistor has a resistance of between 100 and 200 Mohms.

8. The dual design resistor of claim 1 wherein said run resistor has a resistance of between 450 and 500 ohms.

9. The dual design resistor of claim 1 wherein said insulating gas is sulfur hexafluoride.

10. The dual design resistor of claim 2 wherein said motor and said ball screw are disposed within said tubular cavity.

11. The dual design resistor of claim 10 wherein said housing includes an electrical receptacle; and electrical wiring connecting said electrical receptacle with said motor.

12. The dual design resistor of claim 1 wherein said first end of said run resistor is cantilevered from said first end of said housing.

13. The dual design resistor of claim 1 wherein said first end of said conditioning resistor has an input voltage of 350,000 volts.

14. The dual design resistor of claim 13 wherein said conditioning resistor has a resistance of 150 Mohms; and said run resistor has a resistance of 500 ohms.

15. The dual design resistor of claim 14 wherein said dual resistor includes a first position when said second end of said run resistor is insulated from said second end of said conditioning resistor;

a second position when said run resistor establishes electrical contact with said second end of said conditioning resistor;

a first maximum output current at said first position;

a second maximum output current at said second position;

said first maximum output current of said dual resistor is 0.0023 amps; and said second maximum output current of said dual resistor is 700 amps.

16. A dual design resistor comprising:

a first hollow cylindrical resistor including a first end, a second end, and an inner cavity;

a second cylindrical resistor sealed within said inner cavity of said first resistor;

said second resistor having a supported end and a free end within said inner cavity of said first resistor;

said free end of said second resistor insulated from said second end of said first resistor;

said first resistor in electrical contact with said second resistor at said first end;

said first resistor having a higher resistance than said second resistor; and a drive assembly within said cavity for advancing said second resistor within said inner cavity until said second resistor shorts out said first resistor.

* * * * *